US008117819B2

(12) United States Patent
Scott

(10) Patent No.: US 8,117,819 B2
(45) Date of Patent: Feb. 21, 2012

(54) VEHICLE CHAIN REPAIR DEVICE

(75) Inventor: Steven Richard Scott, Belmont, CA (US)

(73) Assignee: Motion Pro, Inc., San Carlos, CA (US)

( * ) Notice: Subject to any disclaimer, the term of this patent is extended or adjusted under 35 U.S.C. 154(b) by 81 days.

(21) Appl. No.: 12/794,292

(22) Filed: Jun. 4, 2010

(65) Prior Publication Data

US 2011/0016843 A1 Jan. 27, 2011

Related U.S. Application Data

(60) Provisional application No. 61/228,739, filed on Jul. 27, 2009.

(51) Int. Cl.
*B21L 21/00* (2006.01)

(52) U.S. Cl. ..... 59/7; 59/11

(58) Field of Classification Search ..... 59/7, 8, 59/11

See application file for complete search history.

(56) References Cited

U.S. PATENT DOCUMENTS

| | | | | | |
|---|---|---|---|---|---|
| 1,436,429 | A * | 11/1922 | Bean | 59/7 |
| 2,783,611 | A * | 3/1957 | Simpkin et al. | 59/7 |
| 2,826,893 | A * | 3/1958 | Morris et al. | 59/7 |
| 2,931,165 | A * | 4/1960 | Tehven | 59/7 |
| 4,833,875 | A * | 5/1989 | Buermann et al. | 59/7 |
| 5,140,736 | A * | 8/1992 | Hsiao | 29/243.54 |
| 7,797,920 | B2 * | 9/2010 | Wang | 59/7 |
| 2009/0025529 | A1 * | 1/2009 | Perrotta | 84/327 |

* cited by examiner

*Primary Examiner* — David Jones

(74) *Attorney, Agent, or Firm* — Patent Law Office of Larry Guernsey; Larry Guernsey

(57) ABSTRACT

A chain repairing tool, which includes a tool body and a PBR block, which is configured for pressing side plates of chain links, for breaking chain links and for riveting chain links as the PBR block is variously oriented within the tool body of the chain repairing tool. Also, a chain repairing tool, having a tool body, a body bolt, which is threadably received by the tool body, and a breaking pin where the body bolt includes a tapered passage, which guides the breaking pin. Also, the breaking pin includes a domed head. Also, a PBR block, which is configured for pressing side plates of chain links, for breaking chain links and for riveting chain links as said PBR block is variously oriented, in conjunction with a chain repairing tool.

18 Claims, 14 Drawing Sheets

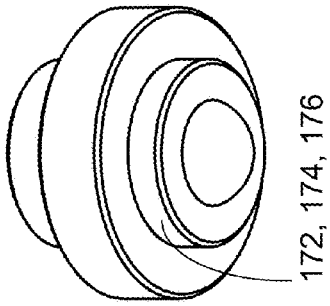
FIGURE 18C
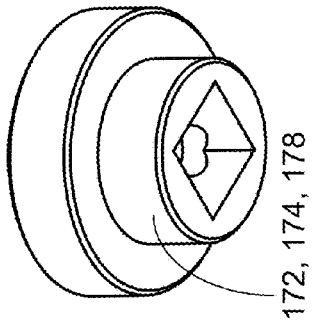
FIGURE 18D
FIGURE 18B
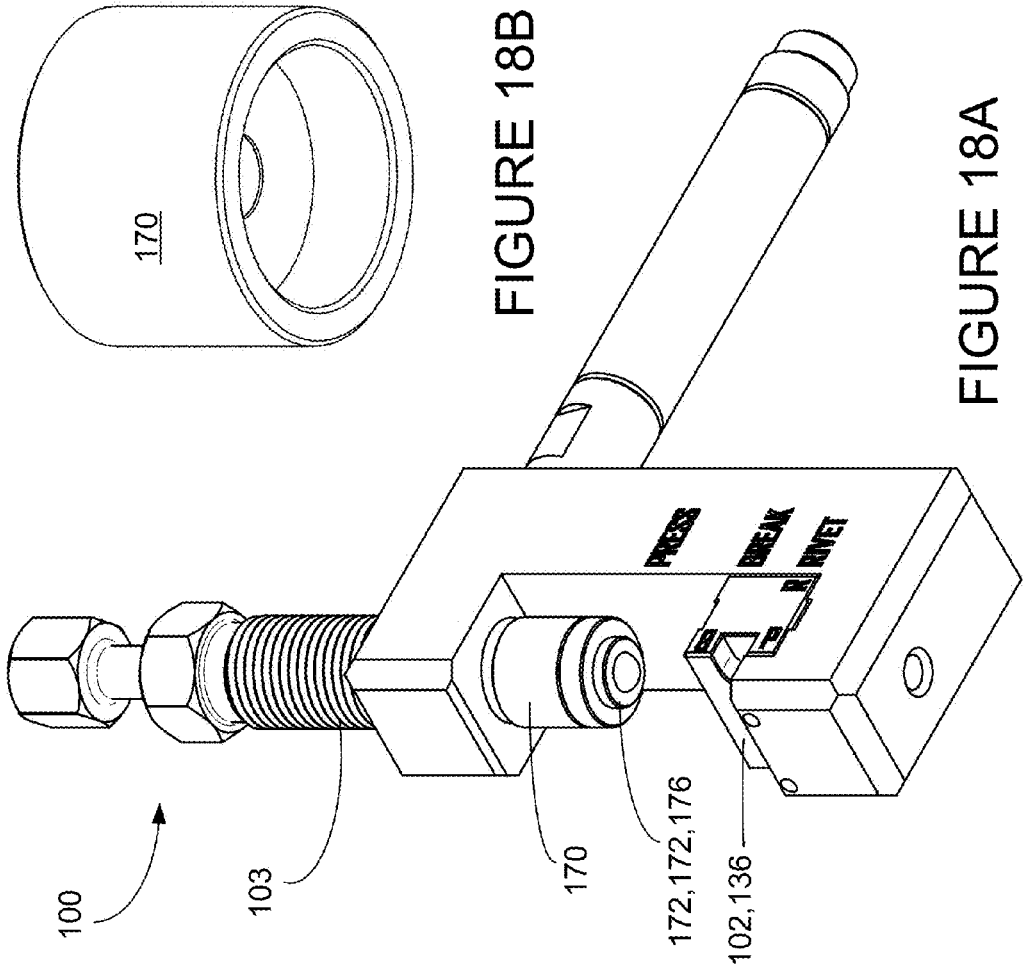
FIGURE 18A

VEHICLE CHAIN REPAIR DEVICE

The following is a non-provisional patent application which claims priority to provisional application 61/228,739 filed Jul. 27, 2009 to the same inventor.

TECHNICAL FIELD

The present invention relates generally to metal working tools and more particularly to accessories for attaching and detaching chain links for bicycle and motorcycle chain applications.

BACKGROUND ART

Chains are typically used in both bicycles and motorcycles as a means of transferring the rotary motion of the riders pedaling action or the motorcycle's motor to the rear wheel. The chain is especially useful at transferring this rotary motion to a variety of gears by use of a gear shifter. The nature of the chain, having a number of links that can pivot with respect to each other, allows the chain to thread between gears in a very flexible manner.

Motorcycle and bicycle chains are generally configured with a number of link pairs, which are connected to each other by side plates. The link pair has two link pair members. A first link pair member of a first link pair is connected to a first end of a side plate. The second end of the side plate is then also connected to a first link pair member of a second link pair. These connections are made by chain pins, which are press-fit into the link pair members and side plate.

The chains may be supplied in certain standardized lengths, which may be too long or two short for the exact cycle to which it is to be fitted. In addition, links of chains may become damaged by being bent, chipped, or otherwise deformed. It may be necessary to replace these links in order that the chain is not to fail or present a safety hazard. In either case, the chain may be "broken" by removing the chain pin that joins the links. When the link is broken at both ends, the link can be removed entirely and the neighboring links reattached, or a replacement link may replace the damaged one, and the chain pins then replaced to reconnect the chain.

The chain can similarly be shortened by removing links or lengthened by adding links and then replacing the connecting chain pins. It is sometimes the practice to include one special link called a "master link" on which breaking or rejoining is commonly performed. This master link is sometimes different in shape or color than the rest of the links and may employ rivets to permanently lock the chain pins of the master link in place.

Before the 1970's, most all chains came with a clip type master link. This master link could be removed simply with a pair of pliers by removing the safety clip. The only time it became necessary to break a chain was to shorten a length of chain to be installed. Rivet style master links were developed in the early 1970's because the more powerful motorcycles were having issues with breaking chains during hard acceleration. Shortly after, in the late 1970's O ring chains were introduced with press on rivet master links to increase durability by sealing the chain from water and debris. Thus the chain riveter was developed for use with these types of chains.

Most of the current chains use either rivet "hollow nose master links" or "quad stake master links". In the motorcycle world, hollow nose master links are much more common than the quad stake but it is generally accepted that the quad stake is a more secure method.

FIG. 1 shows a drawing of a chain 1, with its various parts and elements. A chain 1 includes link pairs 2, which have a pair of link pair members 3. The links 2 are joined by side plates 4 and possibly by master links 10, which can be thought of as a specialized type of side plate 4, which have a first end 7 and a second end 8. The link pairs 2 shown include a first link pair member 5, which for this discussion will be the link pair member on the right, and a second link pair member 6, which for this discussion will be the link pair member on the left. Thus the first link pair member 5 of a first link pair 2 is connected to the first end 7 of side plate 4, and the second end 8 of side plate 4 connects to the second link pair member 6 of a second link pair 2. Connections between the link pair members and the side plates are made by chain pins 9, which extend through the side plates 4 through the link pair members 2 and finally through a lower side plate 4.

A master link 10 is produced by taking a side link 4 which has two chain pins 9 which are press-fit into holes in the side plate 4. A master link 10 is shown in FIG. 2, including chain pins configured as rivets 11. The top side plate 4 has been pressed onto the rivets 11, and then the tips 12 of the rivets 11 have been spread to prevent removal. It may be possible to later press the rivets out of the master link 10 and thus break the chain 1, although rivets 11 are generally used to make a more permanent connection. These rivets may be of the hollow nose master link or quad stake master link types and a different type of rivet head tip is generally used for the two different types. A hollow nose rivet 13 is shown in FIG. 2.

There are several reasons why a user may want to break a chain and then rivet it. These include:

Gearing change. When installing a larger or smaller sprocket to change the final drive it is often necessary to add or remove a link or two so that the wheel can be kept within the allowable wheel adjustment.

Replacement. New style O ring or press on link chains may not come apart unless the chain is physically cut. A chain breaker is required to remove the old master link and install the new one.

Engine removal. It is not possible on most motorcycles to remove the front sprocket because of the close clearance between the frame and sprocket without first breaking and removing the chain. After the chain is removed it is possible to remove and replace the front sprocket known as the "counter shaft sprocket".

Chain repair tools have existed for years. One such repair tool is manufactured by Motion Pro, Inc. An example of this repair tool with instructional pages on its use is found at:

http://www.motionpro.com/tech/articles/chain_breaker_and_riveting tool/

Images from this instructional page are included in this discussion, which detail the use of the prior repair tool, and which are included in FIGS. 3-8. The included instructions aid in the general understanding of the use of this type of tool.

Referring now to FIGS. 3-4, a chain repair tool 20 is shown in a cut-away view in the process of breaking a chain 1. The repair tool 20 includes a body 22, an body bolt 24, having a head 26, a drive bolt 28, having a drive bolt handle 30, a breaking pin 32 and a main handle 34. A spring 36 is provided which fits between the breaking pin 32 and the interior of the body bolt 24. A hole 40 is also provided to allow the chain pin 9 to pass out of the repair tool 20

The repair tool 20 is assembled by threading the body bolt 24 into the body 22. The breaking pin 32 is inserted into the spring 36 and both are dropped into the body bolt 24 with the spring 36 under the tip head 38. The drive bolt 28 is threaded into the body bolt 24 above the breaking pin 32.

The chain repair tool 20 is placed over the chain 1 as shown in FIG. 4. The breaking pin 32 must be withdrawn at least 2 mm into the body bolt 24 to clear the end of the chain pin 9. One end of the chain pin 9 will be held in position by the end of the body bolt 24, while the other end is held in position by the hole 40 of the tool body 22.

The body bolt 24 is tightened securely against the side plate 4 of the chain 1. The drive bolt 28 is tightened by the drive bolt handle 30 or a 14 mm wrench until the chain pin 9 is pushed completely out and through the hole 40 in the tool body 22. The chain 1 has then been broken.

If side plates 4 are to be replaced, and pressed into place, the repair tool 20 must be reconfigured for pressing. The repair tool 20 is re-assembled as shown in FIG. 5 for pressing the side plates 4. The body bolt 24 will be threaded into the body 22, with the breaking pin 32, spring 36 and drive bolt 28 removed. Two press plates 42 are provided. One press plate 44 with the holes will be inserted into the body bolt 24, and another press plate 46 with a groove will be placed in the hole 40 in the tool body 22.

The new chain 1 with the master link 10, side plate 4 and o-rings (if applicable) is assembled. The assembled master link 10 is positioned in the repair tool 20 as shown in FIG. 6. The side plate 4 with the chain pins 9 will be placed against the grooved press plate 46, and the side plate with the holes 4 will be placed against the press plate with the holes 44.

The body bolt 24 is lightly hand-tightened using a 14 mm wrench 15 until the press plates 44, 46 touch the master link side plates 4. The master link chain pins are checked for proper alignment with the groove and holes in the press plates 44, 46 before final tightening. The body bolt 24 is then tightened until the chain pins 9 (not visible) protrude past the face of the side plate 4.

If a link is to be riveted in place, the repair tool 20 is again reconfigured, as shown in FIGS. 7-8, which show the repair tool 20 configured for riveting hollow-nosed master link pins. The body bolt 24 is threaded into the body 22. The rivet tip 48 (not visible in this figure) is inserted into the body bolt 24. The drive bolt 28 is threaded into the body bolt 24. An anvil 50 is placed in the hole 40 in the tool body 22.

The new side plates 4 of the master link 10 should already be pressed as described above so that the chain pin 9 (not visible) protrudes past the face of the side plate 4 of the master link 10. The repair tool 20 is positioned over the rivet 11 to be riveted, with the hollow end 52 (not visible) of the chain pin 9 facing the rivet tip 48, and the solid end 54 facing the anvil 50.

The body bolt 24 is tightened securely against the side plate 4 of the chain 1. Then using a 14 mm wrench, the drive bolt 28 is tightened very tightly until the rivet tip 48 spreads the hollow nose 52 of the rivet 11. The hollow end 52 of the rivet 11 should be flared over the side plate 4 just enough so that the side plate 4 is solidly held in place. This procedure is repeated on the other rivet 11. FIG. 2 shows a master link 10 with properly flared hollow-nosed rivets 13.

As is apparent from the previous discussion, the prior repair tool 20 requires a number of parts, some of which are not used at any one time, and therefore may be easily misplaced or lost unless they are kept together in a carrying case or tool kit. Additionally, it may be unclear at any one time whether the tool is configured for "breaking", "pressing" or "riveting", and separate attachments may be required for each of these operations. Re-configuring the tool 20 for the various operations may be confusing for users who have limited familiarity with the chain repair.

Therefore, there is a need for a chain repairing tool for attaching, detaching and riveting chain links that combines features of several individual tools into a single convenient unit, which uses fewer parts, which is more easily converted from one configuration to another, and which is clear for which of the various operations of breaking, pressing and riveting the tool is configured

DISCLOSURE OF INVENTION

Briefly, one preferred embodiment of the present invention is a chain repairing tool, which includes a tool body and a PBR block, which is configured for pressing side plates of chain links, for breaking chain links and for riveting chain links as the PBR block is variously oriented within the tool body of the chain repairing tool.

Another embodiment is a chain repairing tool, having a tool body, a body bolt which is threadably received by the tool body and a drive bolt which is threadably engaged within said body bolt, where the body bolt includes a tapered passage which guides the breaking pin.

Another embodiment is a chain repairing tool, having a tool body, a body bolt which is threadably engaged by the tool body, a drive bolt which is threadably engaged within the body bolt and a breaking pin which is seated within the body bolt. The breaking pin is engaged with the drive bolt such that as the drive bolt is advanced within the body bolt, the breaking pin is advanced. The breaking pin includes a domed head.

Also disclosed is a PBR block, which is configured for pressing side plates of chain links, for breaking chain links and for riveting chain links as the PBR block is variously oriented, in conjunction with a chain repairing tool having a body bolt.

An advantage of the present invention is that it includes a PBR block, which takes the place of numerous prior accessories.

Another advantage of the present invention is that it includes a breaking pin, which has been modified to bind less within the repair tool.

A further advantage of the present invention is that it includes a body bolt, which includes a tapering passage which helps with the proper alignment of the breaking pin.

And another advantage of the present invention is that it includes an adaptor to install rivet tips for riveting operations.

Yet another advantage of the present invention is that it includes a dual-sided rivet tip, which includes rivet tips for both hollow nose rivets and quad stake rivets.

A further advantage of the present invention is that it is configured so that the adaptor and rivet tip are attached to the handle of the tool when not being used.

A yet further advantage of the present invention is that it provides a block which is reversible and turns to aid in operations of Pressing, Breaking and Riveting all in the same block.

Still another advantage of the present invention is that it contains fewer parts that can be lost and does not require a carrying case for accessories.

Another advantage of the present invention is that it contains fewer parts, and is less costly to manufacture.

Another advantage is that the design of the tool allows the user to perform multiple operations without the need to disassemble the tool.

These and other objects and advantages of the present invention will become clear to those skilled in the art in view of the description of the best presently known mode of carrying out the invention and the industrial applicability of the preferred embodiment as described herein and as illustrated in the several figures of the drawings.

BRIEF DESCRIPTION OF THE DRAWINGS

The purposes and advantages of the present invention will be apparent from the following detailed description in conjunction with the appended drawings in which:

FIGS. 17, 18A-D and 19 show isometric top and bottom views of the chain repair tool of the present invention in a riveting operation on the links of a chain, with detail views of the adapter and rivet tips of the present invention.

DETAILED DESCRIPTION OF THE PREFERRED EMBODIMENTS

The present invention is an improved repair tool for bicycle and motorcycle chains, which will be referred to by the reference number 100, and thus shall be referred to as chain repair tool 100. A preferred embodiment of the chain repair tool 100 is illustrated in FIGS. 9-19, and these figures will be referred to generally. Where the elements of the improved chain repair tool 100 are similar to those of the previous repair tool 20 discussed in the Background Art section, similar reference numbers will be used.

Figure 2:
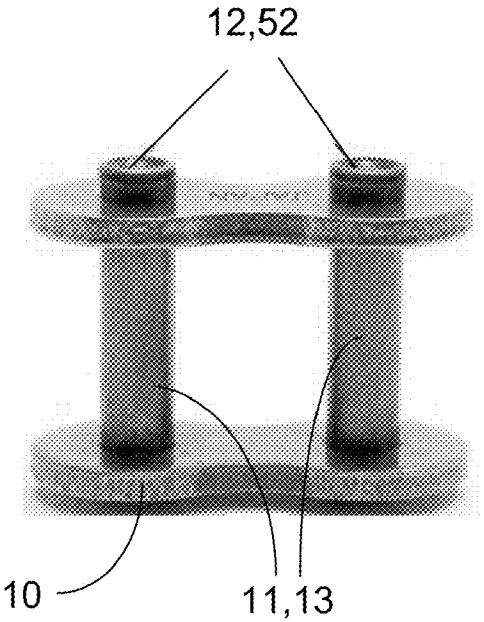
FIGS. 1-2 show views of a chain and a master link.
Figure 1:
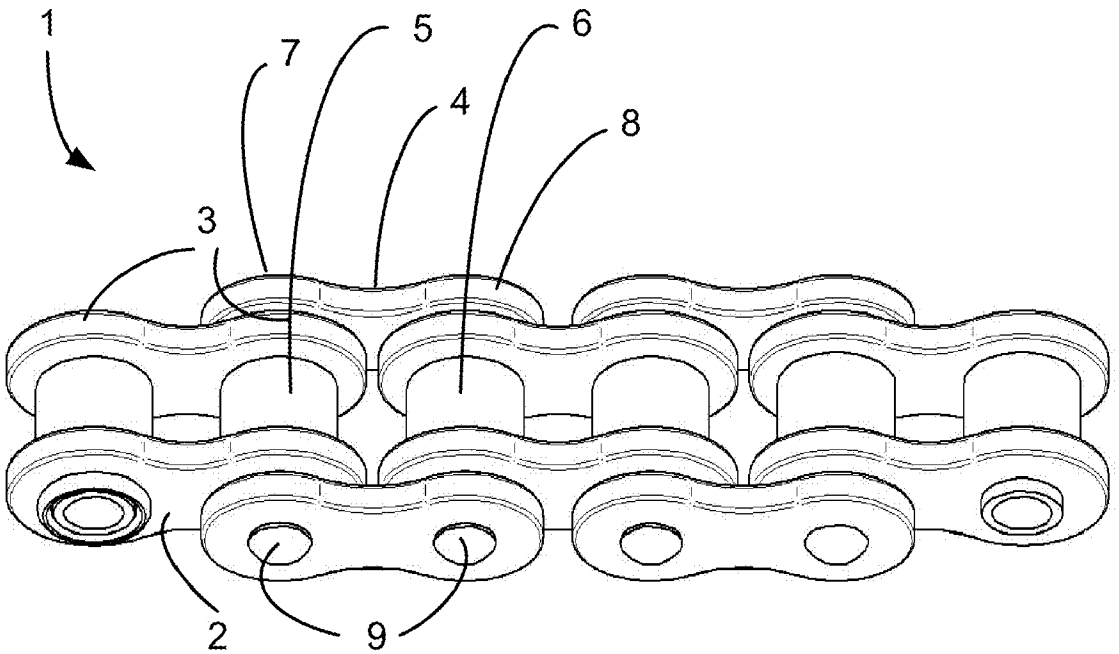
Figure 4:
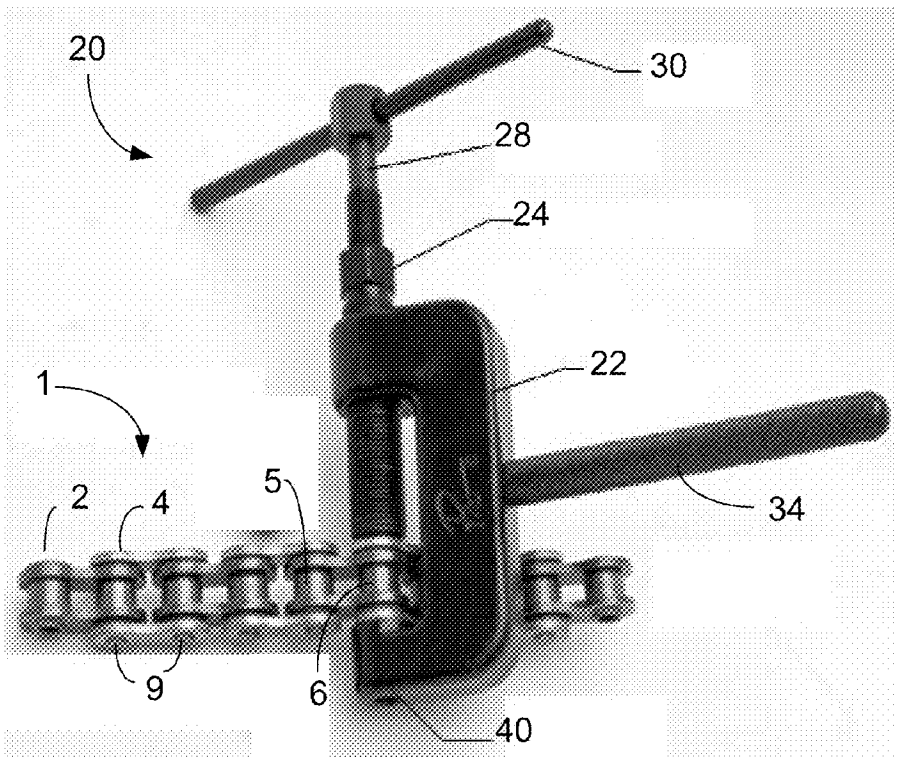
FIG. 4 shows a view of a chain repair tool of the prior art breaking a chain.
Figure 3:
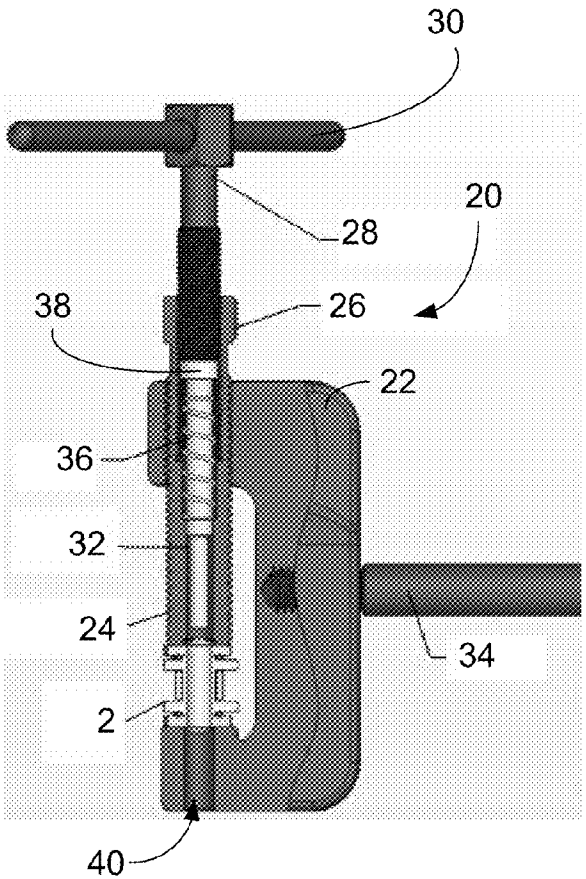
FIG. 3 shows a cross-sectional view of a chain repair tool of the prior art.
Figure 6:
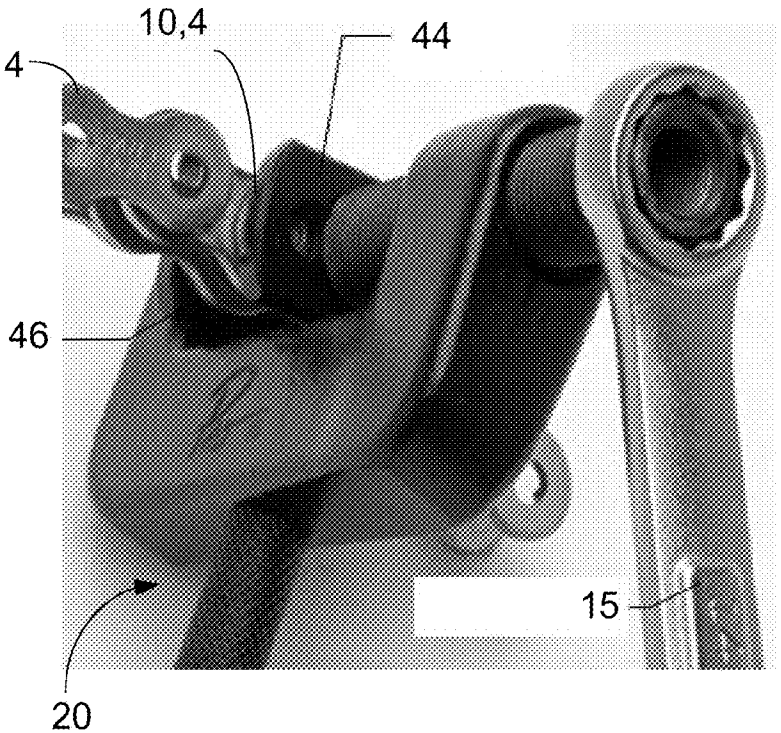
FIGS. 5-6 show views of a chain repair tool of the prior art pressing a link.
Figure 5:
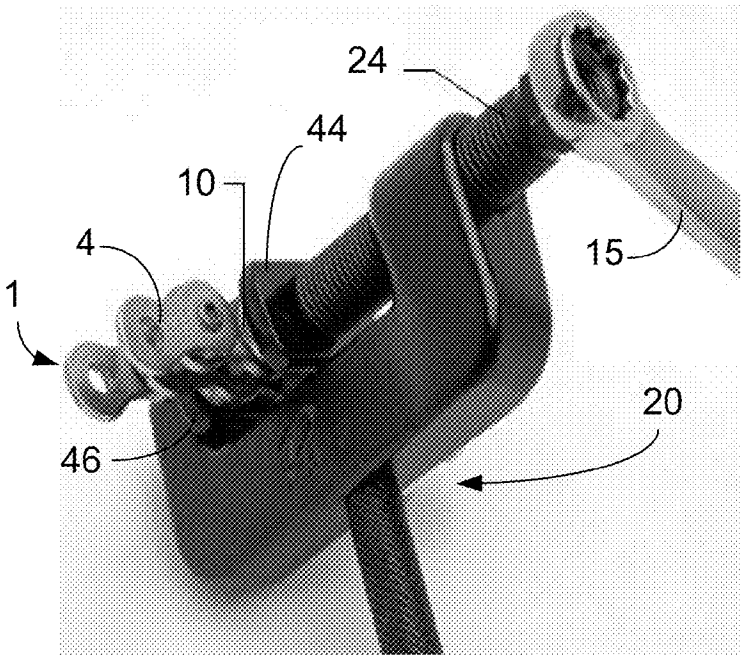
Figure 8:
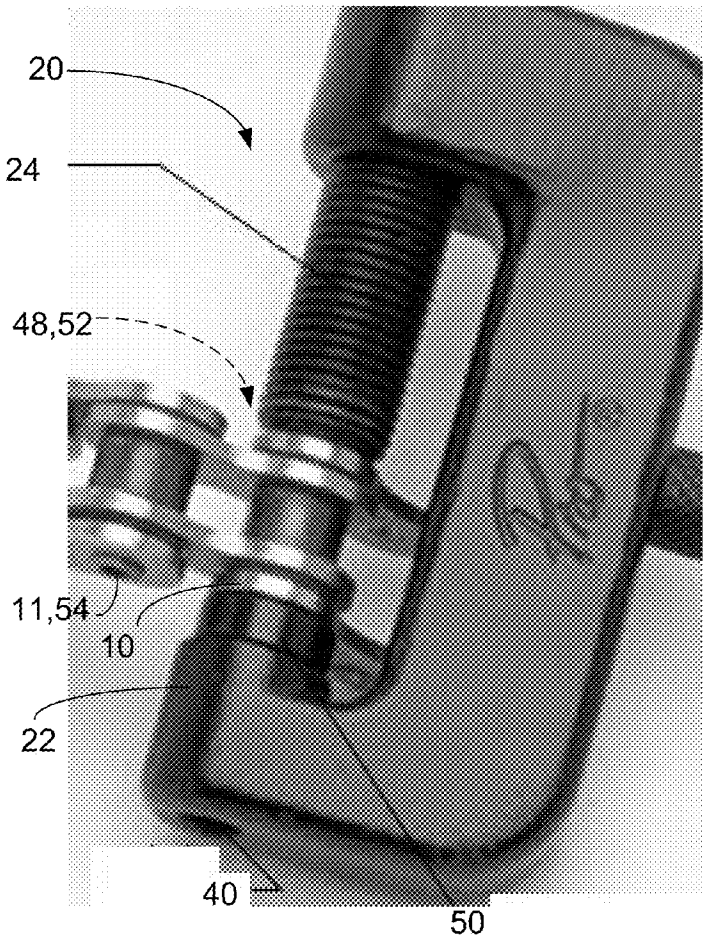
FIGS. 7-8 show views of a chain repair tool of the prior art riveting a link.
Figure 7:
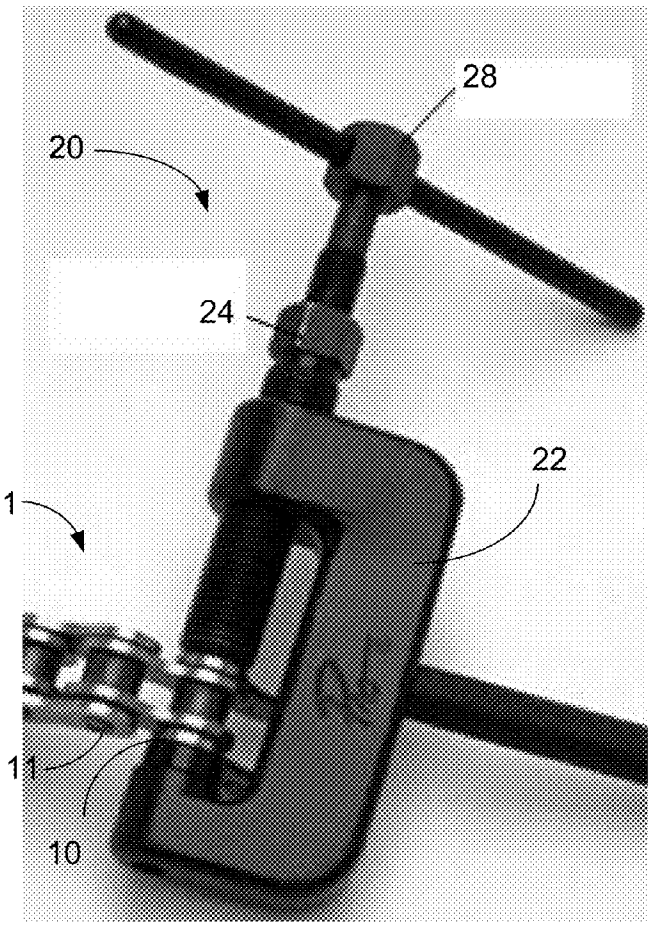
Figure 9:
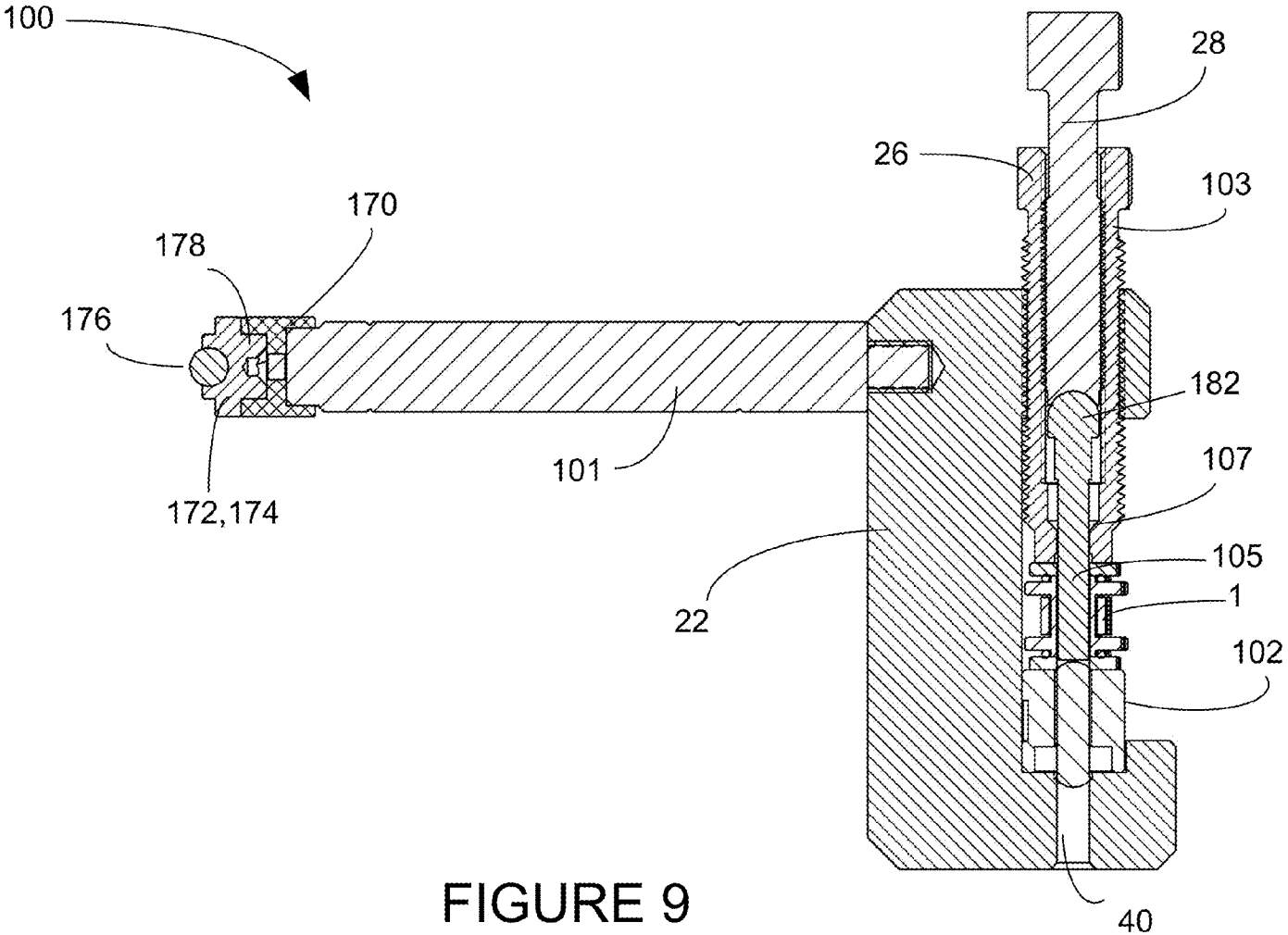
FIG. 9 shows a cross-sectional view of the chain repair tool of the present invention.

Referring specifically now to FIG. 9, the chain repair tool 100 is shown in a cut-away view in the process of breaking a chain 1. The repair tool 100 includes a body 22, a modified body bolt 103, having a head 26, a drive bolt 28, and a modified breaking pin 105 having a domed head 182. The interior of the body bolt 103 includes a tapered passage 107, which helps to guide the breaking pin 105. There is also a modified main handle 101 having an attachment point for an adapter 170 for a rivet tip 172, which is preferably a dual sided rivet tip 174, having a hollow nose rivet tip 176 and a quad stake rivet tip 178. A hole 40 is also provided to allow the chain pin 9 or rivet to pass out of the repair tool 100

One novel feature of the present invention 100 is the PBR block 102. As discussed above, the prior repair tool 20 requires a number of parts, some of which are not used at any one time, and therefore may be easily displaced or lost unless they are kept together in a carrying case or tool kit. Additionally, it may be unclear at any one time whether the tool is configured for "breaking", "pressing" or "riveting", and separate attachments may be required for each of these operations. Re-configuring the prior tool 20 for the various operations may be confusing for some users. Therefore, there is a need for a chain repairing tool for attaching, detaching and riveting chain links that combines features of several individual tools into a single convenient unit, which uses fewer parts, which is more easily converted from one configuration to another, and which is clear for which of the various operations of breaking, pressing and riveting the tool is configured.

The PBR block 102 addresses many of these concerns by providing an accessory which allows all three of the operations of Pressing (P), Breaking (B) and Riveting (R) to be performed with minimal re-configuration of the tool 100. Additionally, the tool 100 and the block 102 are clearly marked to remind the user of the current configuration.

Figure 11:
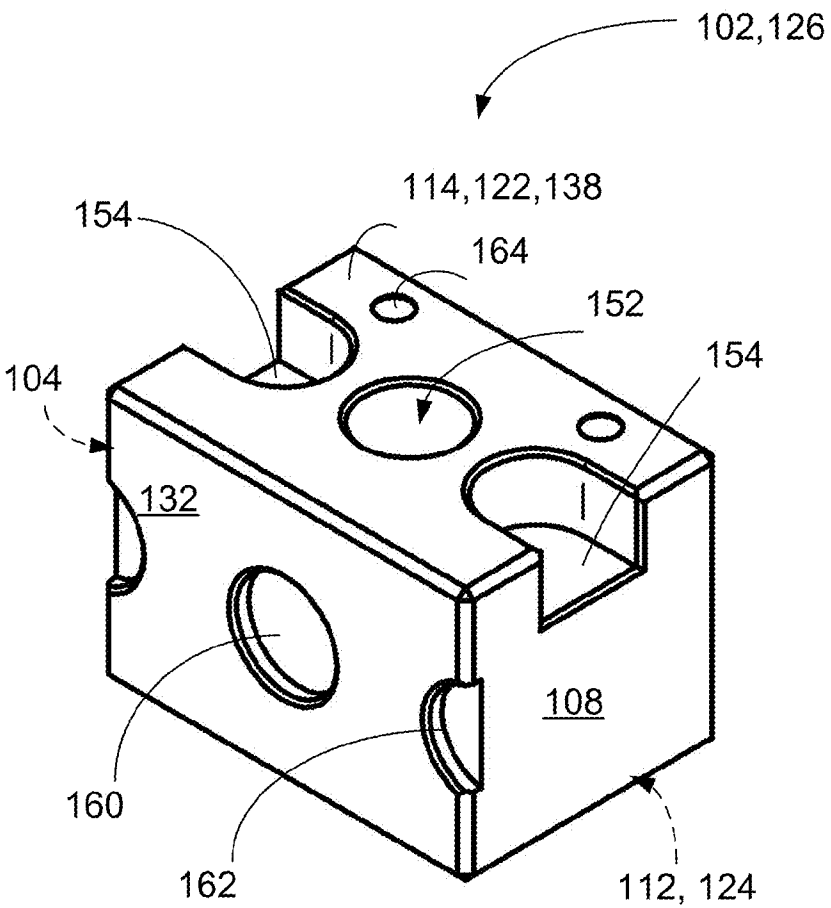
FIGS. 10-11 show isometric top and bottom views of the PBR block of the present invention.
Figure 10:
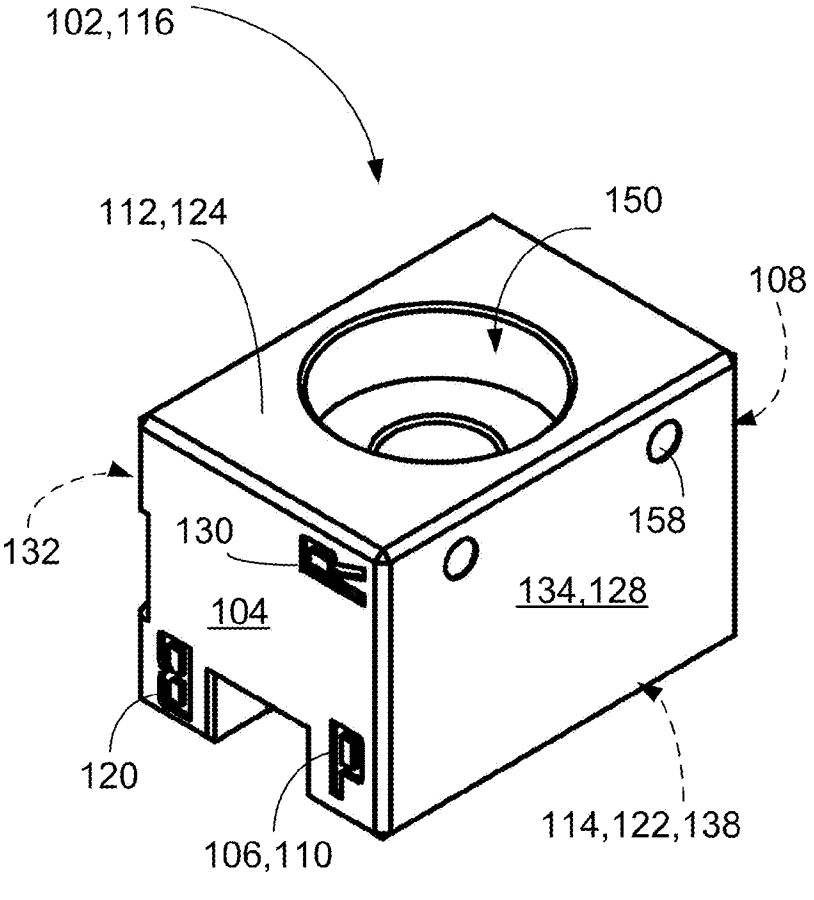

FIGS. 10 and 11 show detail isometric views of the PBR block 102 and the six sides of the block, which have been configured for multiple usage. The block 102 has three basic orientations corresponding to the operations of Pressing (P), Breaking (B) and Riveting (R), which can now be accomplished by turning the block 102 until the proper letter notation is in upright position on the side of the block 102 and aligned with the corresponding mark on the body 22.

The block 102 of course has six sides, and the side with the lettering shall be referred to as the labeled face 104, which includes the indicia 106 of "P", "B" and "R". The opposite side of the block 102 shall be referred to as the rear face 108. When the block is positioned so the "P" marking 110 is upright in the lower right-hand corner as seen from the front of the labeled face 104, the face which is on top shall be referred to as the P top face 112, and the face on the bottom shall be referred to as the P bottom face 114. This shall be referred to as the P orientation 116.

When the block 102 is turned upside down from the P orientation, as when used in breaking operations, the "B" marking 120 will be upright and located in the upper right hand corner as seen from the front of the labeled side 104. The face which is on top during this operation shall be referred to as the B top face 122, and the face on the bottom shall be referred to as the B bottom face 124. This will be referred to as the B orientation 126.

It will be appreciated that physically, the P top face 112 and the B bottom face 124 refer to the same side of the block 102, and likewise the P bottom face 114 and the B top face 122 refer to the same side of the block 102. However, as these P and B faces function differently, they shall be referred to differently, in the manner indicated.

When the block 102 is turned sideways, as when used in riveting operations, the "R" marking 130 will be upright and located in the lower right hand corner as seen from the front of the labeled side 104. The face which is then on top shall be referred to as the R top face 132, and the face on the bottom shall be referred to as the R bottom face 134. This will be referred to as the R orientation 136, which will be discussed below.

Figure 12:
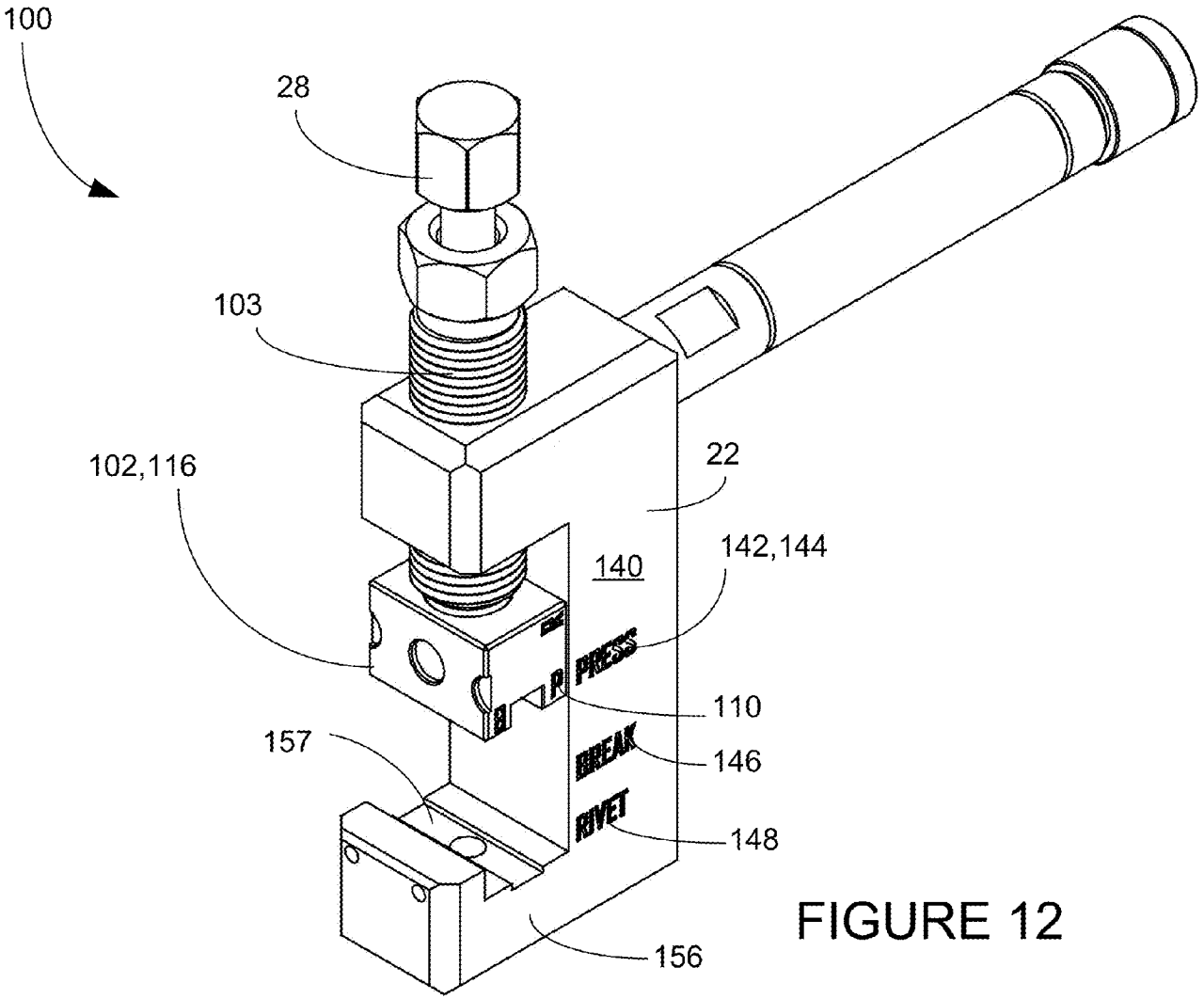
FIGS. 12-14 show isometric top and bottom views of the chain repair tool of the present invention in a pressing operation on the links of a chain.
Figure 13:
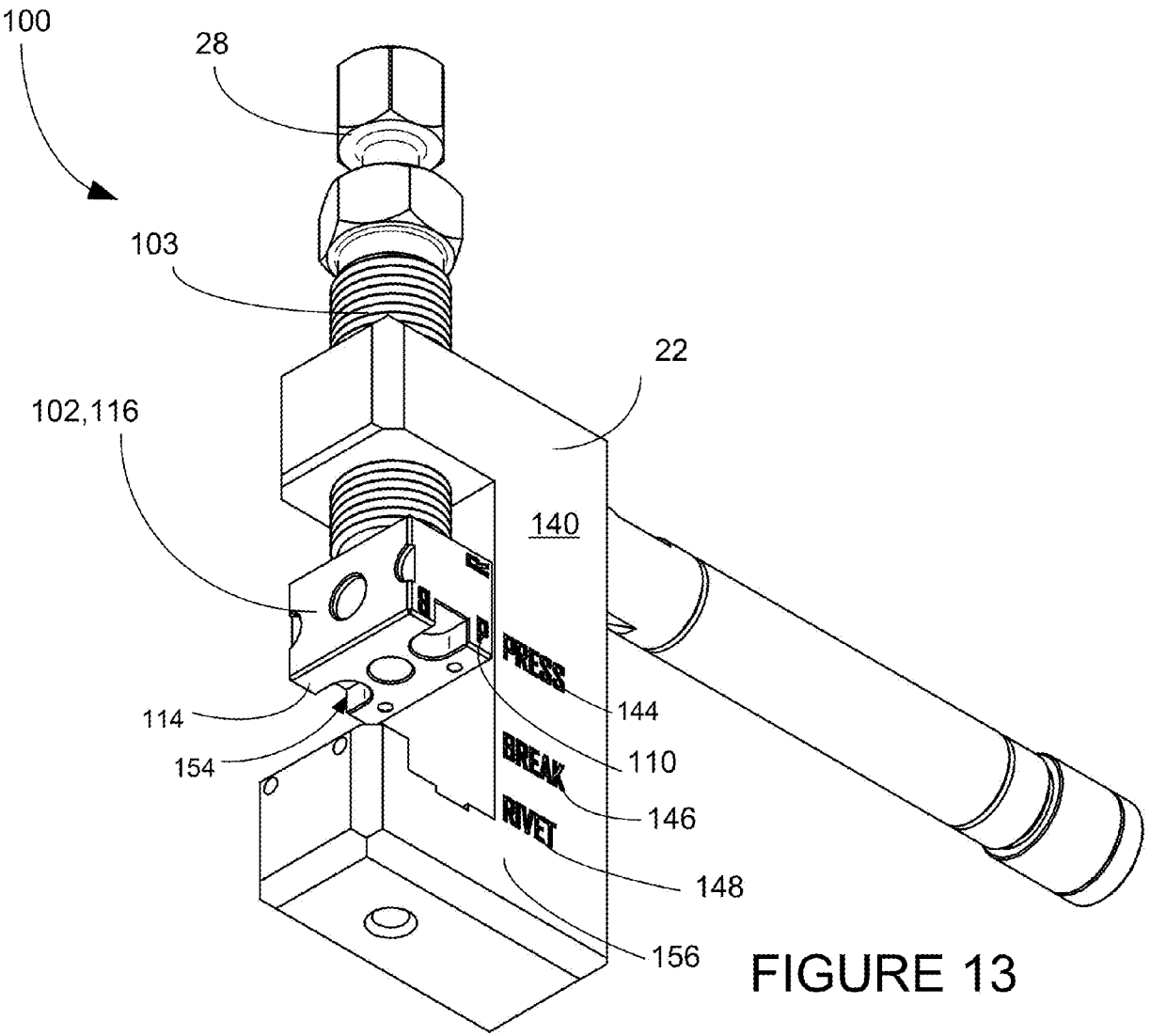
Figure 14:
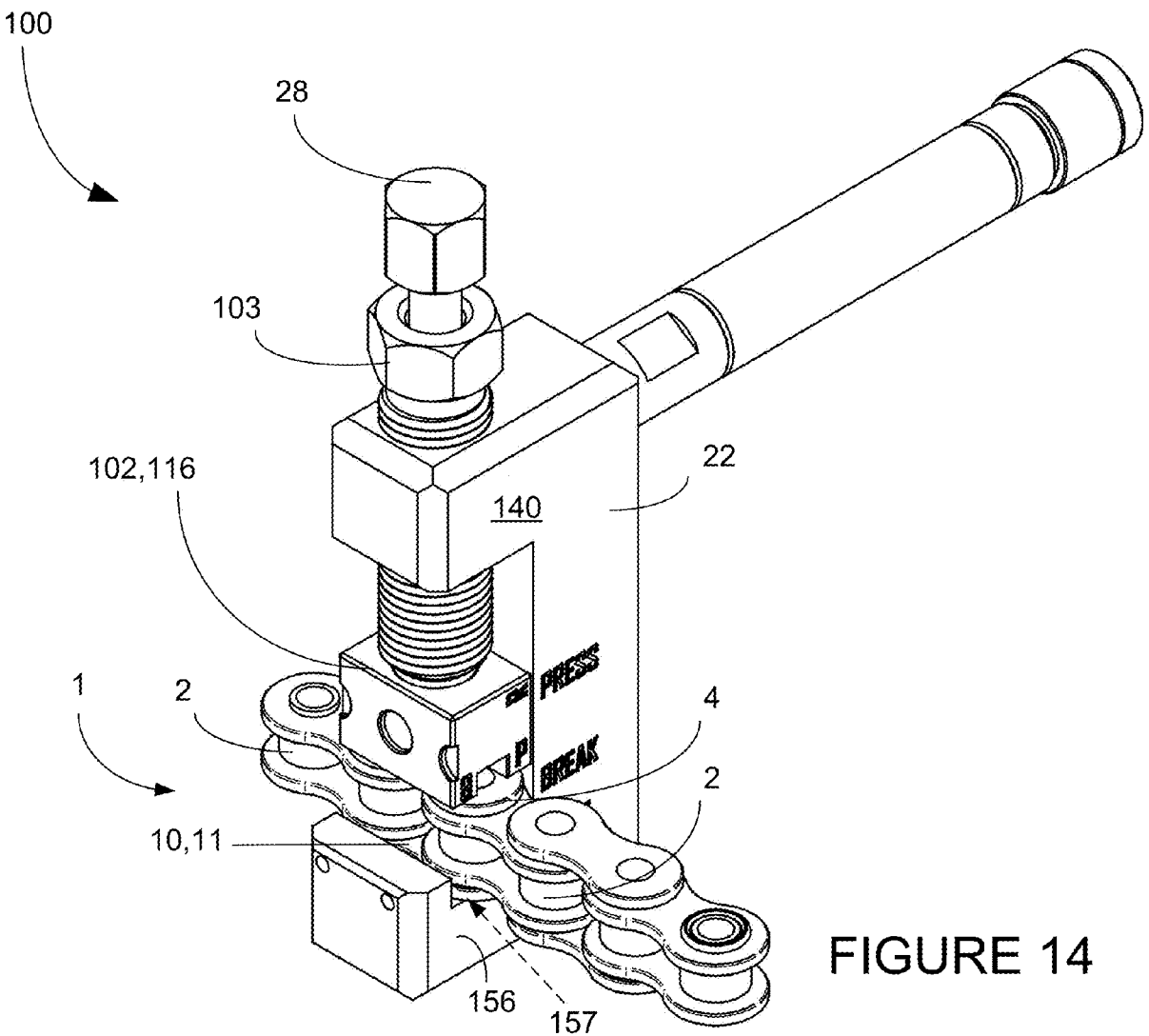

FIGS. 12-14 show the repair tool 100 with the block 102 in P orientation 116 for pressing operations. It will be noted that there is a labeled side 140 of the tool body 22, including body indicia 142. These include the marking "Press" 144, "Break" 146 and "Rivet" 148. When the block 102 is in P orientation 116, the block 102 is attached to the lower end of body bolt 103. The drive bolt 28 is not used in this operation, and is backed out enough that the break pin (not shown) is also withdrawn up into the body bolt 103. The block 102 is now aligned so that the P marking 110 is aligned with the Press marking 144, which serves as a reminder that the repair tool 100 is configured for Pressing operations. The lower jaw 156 is shown, having a groove 157, which helps to align the chain link for the operation.

FIG. 13 shows the P bottom face 114 of the block 102 in which the cut-outs 154 can be seen, which allow space for the rivet ends to protrude.

Referring again to FIGS. 10 and 11, P top face 112 has cavity 150 into which the end of body bolt 103 seats. P bottom face 114 has through hole 152 and side cut-outs 154. The cut-outs 154 allow pins to protrude through a side plate 4 for riveting or installation of a clip.

Referring now particularly to FIG. 14, in operation, the chain 1 seats on the lower jaw 156 of the repair tool 100. The master link 10 is positioned on the lower jaw 156, and the two link pairs 2 are mounted onto the rivets 11 of the master link 10. The side plate 4 is then placed onto the two link pairs 2, with the ends of the rivets 11 engaged in holes in the side plate 4. The body bolt 103 is then tightened until the block 102 engages the side plate 4, and then is further turned by a wrench to press the side plate 4 down onto the rivets 11 until they protrude from the side plate 4 into the cut-outs 154 of the P bottom face 114 (see FIG. 13). The pressing operation is then completed and the chain 1 is removed from the repair tool 100.

Figure 15:
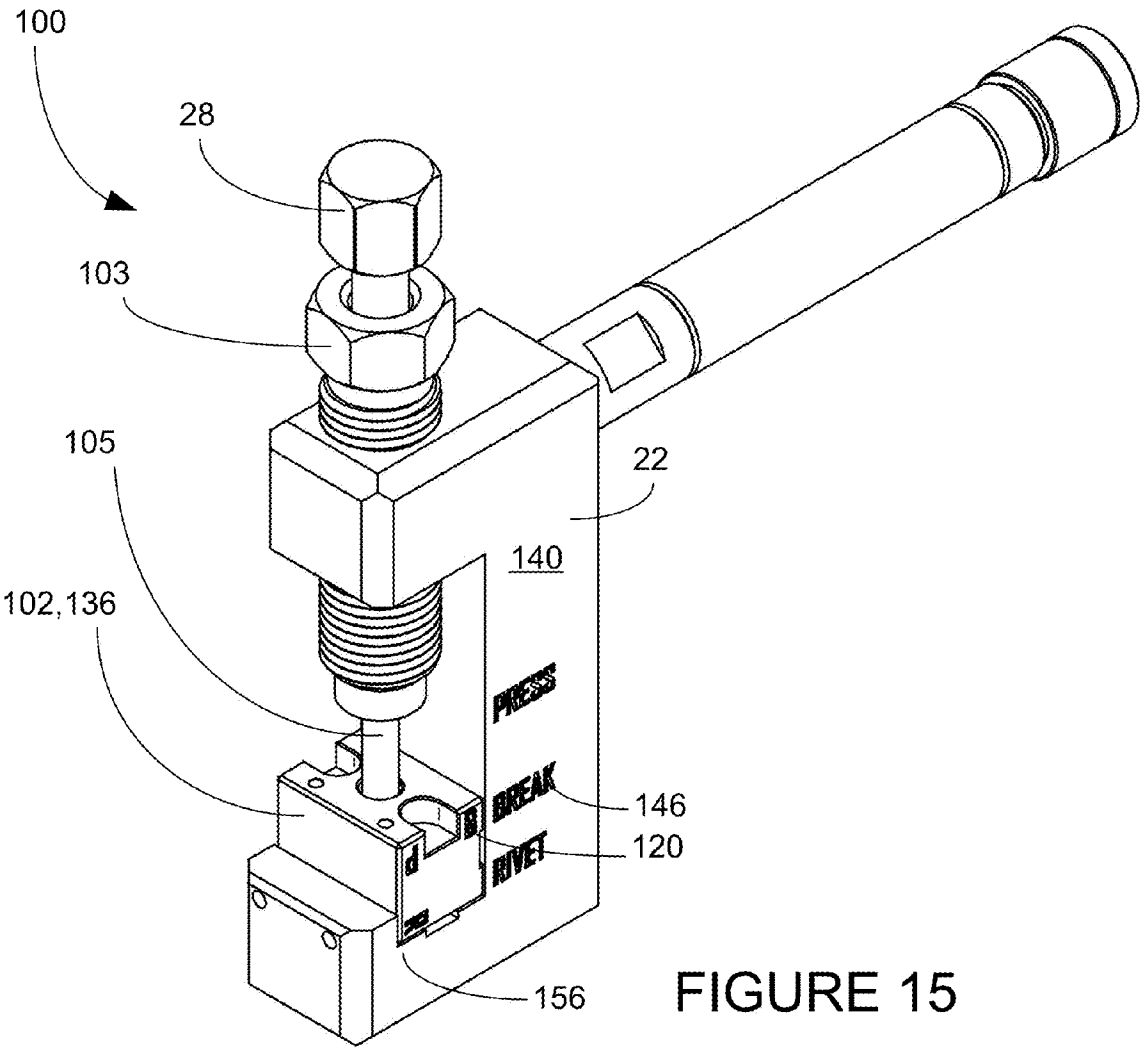
FIGS. 15-16 show isometric top and bottom views of the chain repair tool of the present invention in a breaking operation on the links of a chain.
Figure 16:
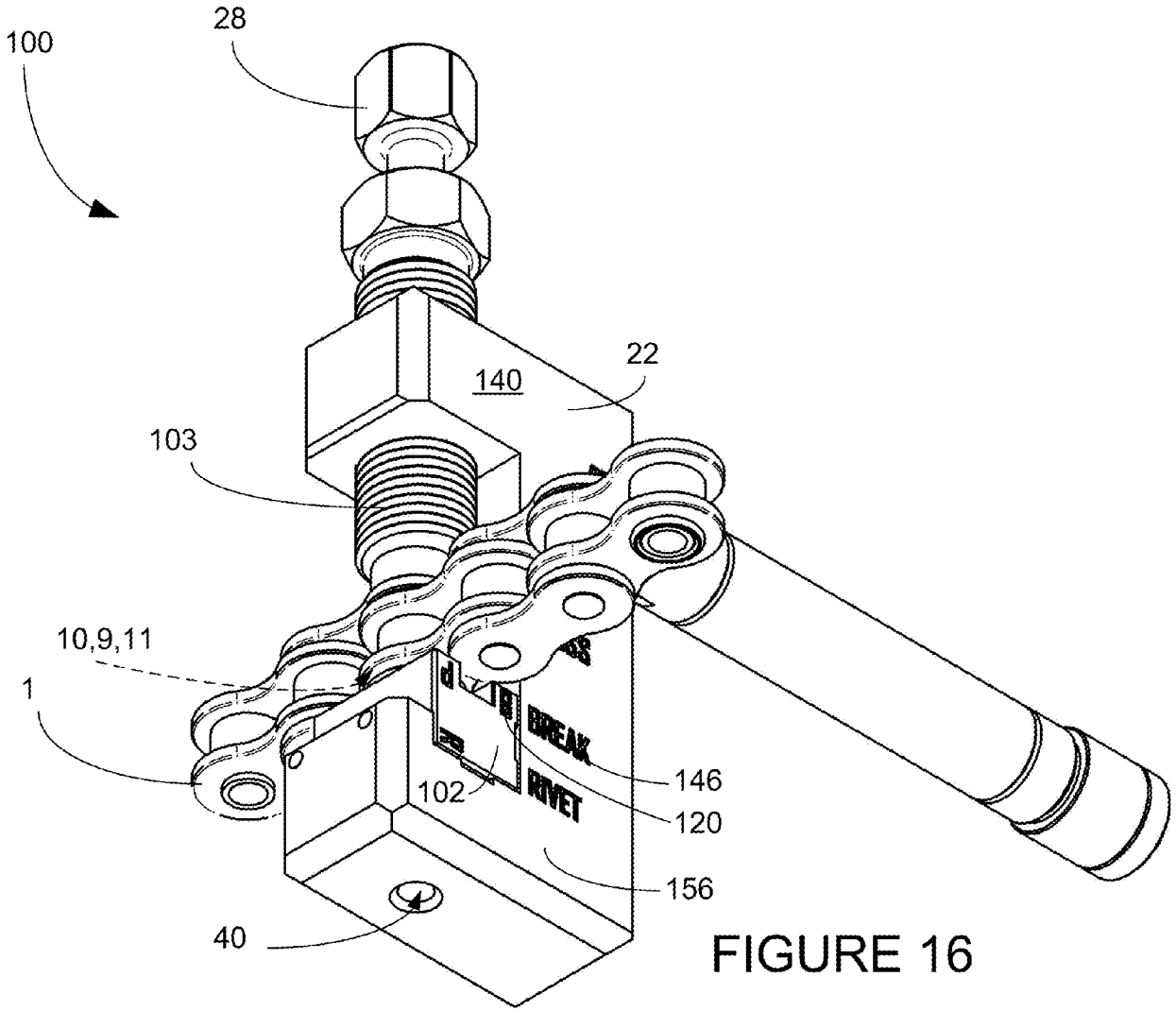

FIGS. 15-16 show the repair tool 100 with the block 102 in B orientation 126 for breaking operations. When the block 102 is in B orientation 126, the block 102 is seated on the lower jaw 156. The drive bolt 28 is used in this operation, and the breaking pin 105 protrudes from the body bolt 103. The block 102 is now aligned so that the B marking 120 is aligned with the Break marking 146, which serves as a reminder that the repair tool 100 is configured for Breaking operations.

Referring again to FIGS. 10 and 11, FIG. 11 shows B orientation 126, as seen from the rear face 108. B top face 122 has a through hole 152 into which the end of the breaking pin 105 extends, and through which the chain pin 9 is ejected out through the hole 40 in the lower jaw 156 of the repair tool 100. Side cut-outs 154 are not used in the breaking operation. B left side face 128 corresponds to the R bottom face 134, and includes location detents 158, which help to maintain the block 102 in proper position on the lower jaw 156. B bottom face 124 has cavity 150 with the continuation of through hole 152.

Referring particularly now to FIG. 16, in operation, the chain 1 seats on the block 102. The master link 10 is positioned so that one of the chain pins 9 or rivets 11 is positioned under the breaking pin 105 (see FIG. 15) and over the through hole 152 (see FIG. 11). The body bolt 103 is then tightened until the chain 1 is held snugly. The drive bolt 28 is then turned by a wrench to drive the breaking pin 105 to press the chain pin 9 or rivet 11 until it protrudes from the bottom side plate 4 into the through hole 152 of the repair tool 100 and out through the bottom hole 40 of the lower jaw 156. The breaking operation is then completed and the chain 1 is removed from the repair tool 100 in separate pieces.

Figure 17:
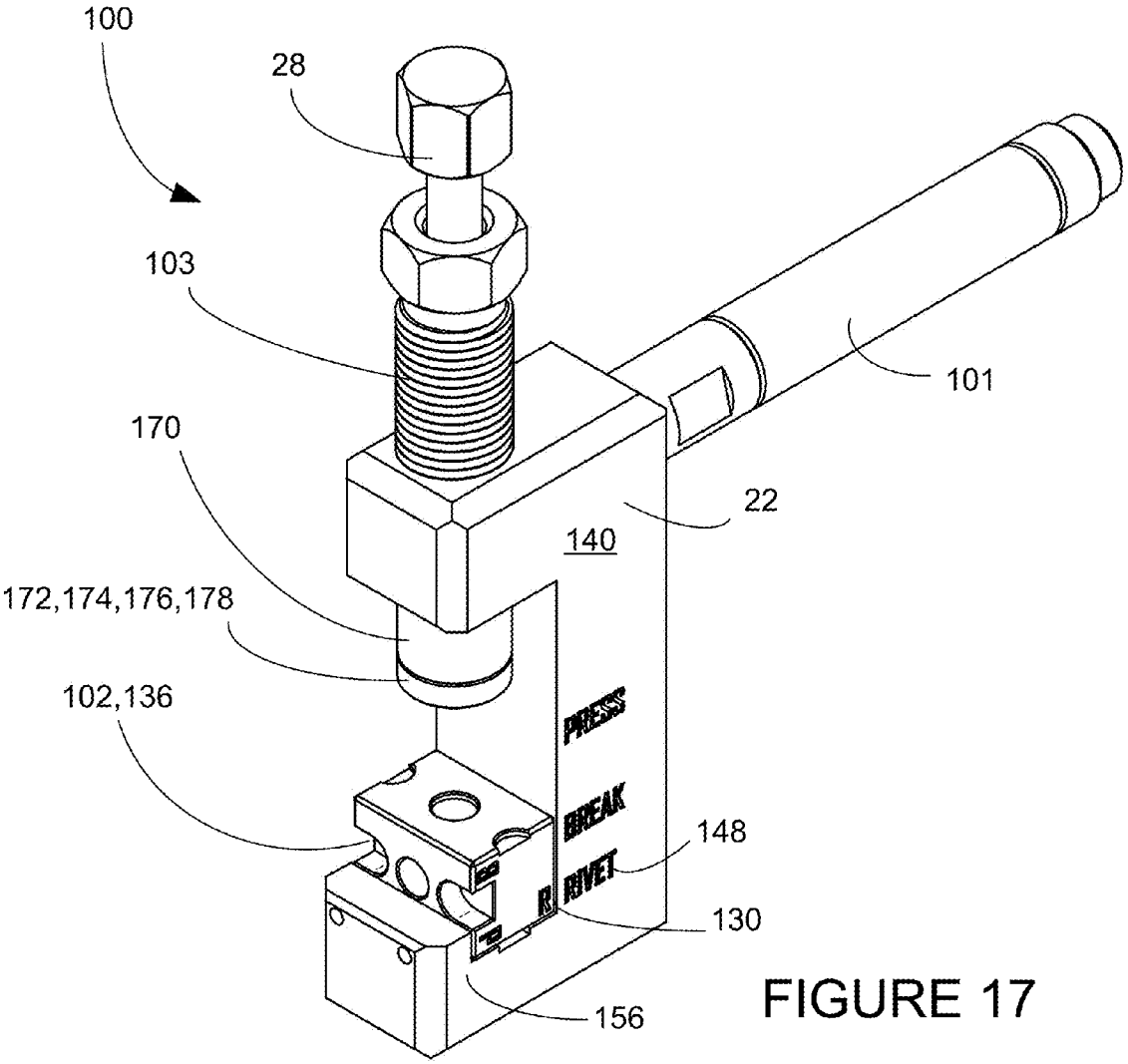
Figure 19:
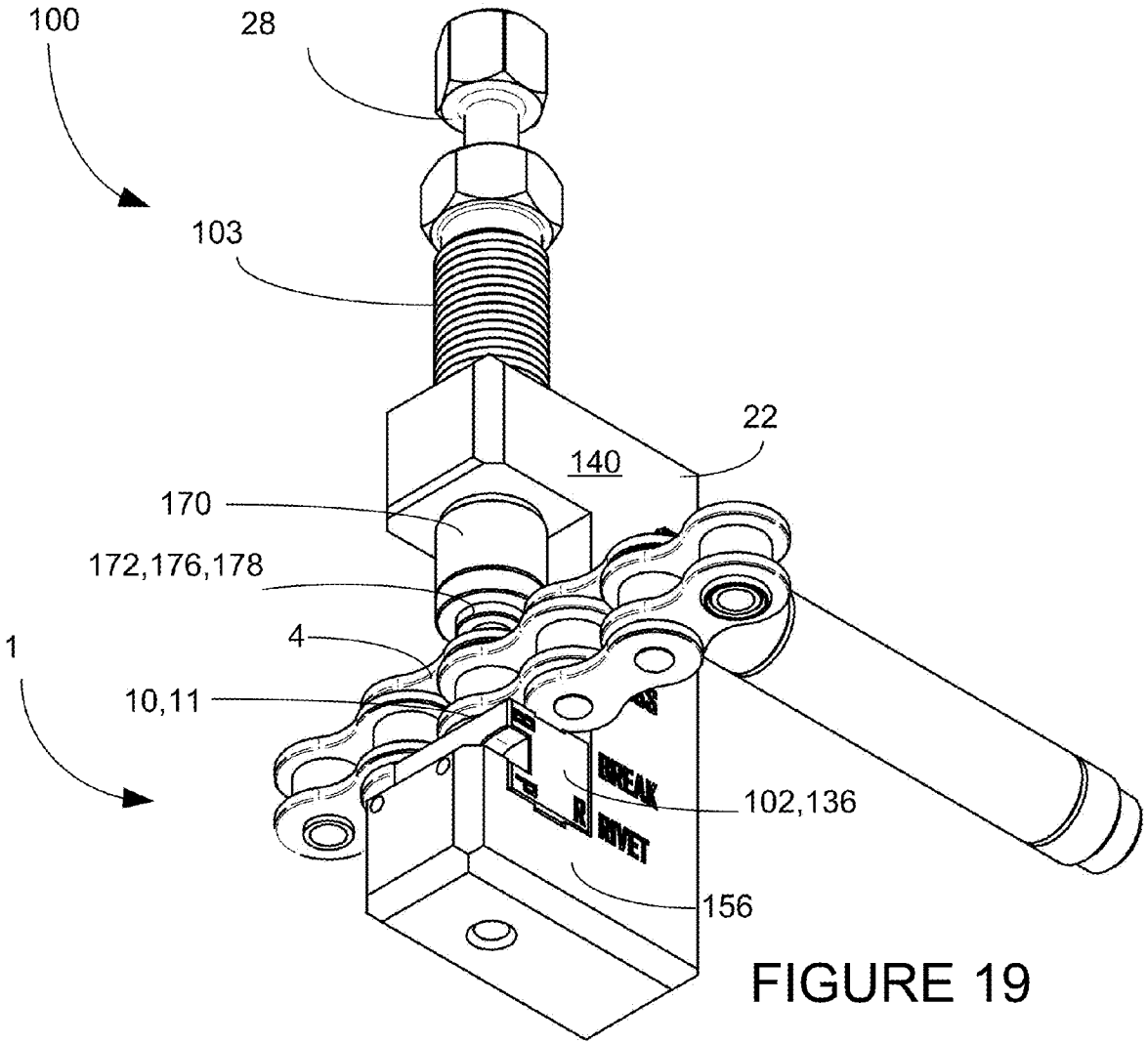

FIGS. 17-19 show the repair tool 100 with the block 102 in R orientation 136 for riveting operations. When the block 102 is in R orientation 136, the block 102 is seated in the lower jaw 156. The drive bolt 28 is not used in this operation, and is again backed out enough that the break pin (not shown) is also withdrawn up into the body bolt 103. The block 102 is now aligned so that the R marking 130 is aligned with the Rivet marking 148, which serves as a reminder that the repair tool 100 is configured for Riveting operations.

FIGS. 18A-D show an adapter 170 is fitted onto the body bolt 103, preferably by means of magnetic attachment, and a rivet tip 172, which is preferably a dual sided rivet tip 174, is also magnetically attached to the adapter 170. The dual sided rivet tip 174 is preferably reversible, so that if it turned in a first orientation, the rivet tip 172 is configured to engage hollow nose rivets, and is thus a hollow nose rivet tip 176, and if reversed, it is configured to engage quad stake rivets, and is thus a quad stake rivet tip 178. When not being used for riveting operations, the adapter 170 and dual sided rivet tip 174 attach to the end of the main handle 101 and thus do not require a special carrying case Referring again to FIGS. 10 and 11, R top face 132 has hole 160 into which the end of the rivet 11 seats. R top face 132 also has side cut-outs 162 into which ends of neighboring rivets 11 can fit. R left sided face 138 (which is also P bottom face 114) also has location detents 164, which help maintain the block 102 in proper position.

Referring now particularly to FIG. 19, when the repair tool 100 is configured for riveting the block 102 acts as an anvil upon which the master link 10 is seated. The side plate 4 has been previously pressed onto the rivets 11. The body bolt 103 is then tightened until the rivet tip 172 engages the head of the rivet 11, and then is further turned by a wrench to press the rivet tip 172 to spread the head of the rivet 11, and thus prevent its removal. A hollow nose rivet tip 176 has a dome-shaped tip, which engages the hollow cylinder of the hollow nose rivet, and forces the material to deform. A quad stake rivet tip 178 has a pyramidal cavity which engages the solid end of the quad stake rivet, and "swedges" the tip by deforming it into a four sided shape which also spreads the head of the rivet so it cannot be easily removed. The riveting operation is then completed and the chain 1 is removed from the repair tool 100.

It is noted that the basic principal and features of the present chain repair tool 100 work for both motorcycle and bicycle chains. It will be apparent to one skilled in the art that a repair tool of larger or smaller size can easily be designed using the inventive features of the present invention.

There are many advantages to the present invention 100. As discussed above, the repair tool 100 additionally preferably includes a modified breaking pin 105 which includes a domed upper end 182, which more easily engages the lower end of the drive bolt 28 as it advances. This helps the breaking pin 105 stay aligned in the body bolt 103 while the drive bolt 28 is inserted. A common problem with many chain breakers is misalignment of the breaking pin. When the breaking pin is misaligned it can bind up in the body bolt and bend or break.

The present body bolt 103 incorporates a tapered passage 107 as shown previously in FIG. 9. In prior repair tools, the pin can get bound up on the internal lip of the body bolt and break the tool. This design makes the repair tool 100 easier to use and reduces the chance of damage to the repair tool 100.

One of the motivations of present invention was to include fewer parts. Most chain breakers require several extra pieces that must be stored separately to accomplish the complete job of breaking (removing) the old chain, and installing a new one. With prior chain breaker/riveters, to complete the job of replacing the chain requires installing and removing various specialized pieces into the tool, such as rivet plates, press plates . . . etc. One advantage of the present invention is that all of those features are incorporated into the PBR block 102. This allows the user to quickly change from breaking the chain to pressing the new link on and then riveting with less parts and less time spent swapping components. It also means less separate pieces that can get lost or need to be stored. This all results in reduced manufacturing costs.

Another motivation was to make the present invention easier to use. With the PBR block 102, the user simply aligns the corresponding marks on the block 102 with the markings 142 on the body 22 and the alignment is done. This was an attempt to make a tool that didn't need instructions at all, in comparison to the prior chain repair tool, which had several pages on a web-site to explain its operation and re-configurations.

Another motivation for this tool was to have "No Loose Parts" as opposed to the prior chain repair tool. The present repair tool 100 accomplishes this. As discussed above, the handle 101 has the feature that its end acts as a storage place for the adaptor 170 and rivet tip 172 when not in use.

While various embodiments have been described above, it should be understood that they have been presented by way of example only, and not limitation.

INDUSTRIAL APPLICABILITY

The present vehicle chain repairing tool 100 is well suited generally for repairing vehicle drive chains. It accomplishes this by allowing easier pressing, breaking and riveting of links in the vehicle chain. The present invention presents a vehicle chain repairing tool for attaching, detaching and riveting chain links that combines features of several individual tools into a single convenient unit, which uses fewer parts, which is more easily converted from one configuration to another, and for which it is easily clear for which of the various operations of breaking, pressing and riveting, the tool is configured. It is noted that the basic principal and features of the present chain repair tool 100 work for both motorcycle and bicycle chains.

A user may want to break a chain and then rivet it in order to effect a gearing change, replacement or engine removal. These operations may require that the chain being broken, the side plates of one or more links be replaced, and rivets be installed. These require the actions of "breaking", "pressing" and "riveting", respectively.

One novel feature of the present vehicle chain repairing tool 100 is the PBR block 102, which provides an accessory which allows all three of the operations of Pressing (P), Breaking (B) and Riveting (R) to be performed with minimal re-configuration of the tool 100 and which are indicated on the PBR block with corresponding markings to remind the user of the current configuration. Additionally, there is a labeled side 140 of the tool body 22, including body indicia 142. These include the markings "Press" 144, "Break" 146 and "Rivet" 148.

The block 102 has three basic orientations corresponding to the operations of Pressing (P), Breaking (B) and Riveting (R), which can now be accomplished by turning the block 102 until the proper letter notation is in upright position on the side of the block 102 and the letter notation is aligned with the corresponding body indicia 142 on the tool body 22.

When the block 102 is used in breaking operations, the "B" marking 120 will be upright and located in the upper right hand corner as seen from the front of the labeled side 104. When the block 102 is in B orientation 126, the block 102 is seated on the lower jaw 156. The drive bolt 28 is used in this operation, and the breaking pin 105 protrudes from the body bolt 103. The block 102 is now aligned so that the B marking 120 is aligned with the Break marking 146, which serves as a reminder that the vehicle chain repairing tool 100 is configured for Breaking operations.

B top face 122 has a through hole 152 into which the end of the breaking pin 105 extends, and through which the chain pin 9 is ejected out through the hole 40 in the lower jaw 156 of the repair tool 100. B left side face 128 includes location detents 158, which help to maintain the block 102 in proper position on the lower jaw 156. B bottom face 124 has cavity 150 with the continuation of through hole 152.

The chain 1 seats on the block 102. The master link 10 is positioned so that one of the chain pins 9 or rivets 11 is positioned under the breaking pin 105 and over the through hole 152. The body bolt 103 is then tightened until the chain 1 is held snugly. The drive bolt 28 is then turned by a wrench to drive the breaking pin 105 to press the chain pin 9 or rivet 11 until it protrudes from the bottom side plate 4 into the through hole 152 of the repair tool 100 and out through the bottom hole 40 of the lower jaw 156. The breaking operation is then completed and the chain 1 is removed from the repair tool 100 in separate pieces.

When the block 102 is in P orientation 116, for pressing operations, the block 102 is attached to the lower end of body bolt 103. The drive bolt 28 is not used in this operation, and is backed out enough that the break pin is also withdrawn up into the body bolt 103. The block 102 is now aligned so that the P marking 110 is aligned with the Press marking 144, which serves as a reminder that the vehicle chain repairing tool 100 is configured for Pressing operations. The lower jaw 156 includes a groove 157, which helps to align the chain link for the operation.

The P top face 112 has a cavity 150 into which the end of body bolt 103 seats. P bottom face 114 has through hole 152 and side cut-outs 154. The cut-outs 154 allow pins to protrude through a side plate 4 for riveting or installation of a clip.

The chain 1 seats on the lower jaw 156 of the vehicle chain repairing tool 100. The master link 10 is positioned on the lower jaw 156, and the two link pairs 2 are mounted onto the rivets 11 of the master link 10. The side plate 4 is then placed onto the two link pairs 2, with the ends of the rivets 11 engaged in holes in the side plate 4. The body bolt 103 is then tightened until the block 102 engages the side plate 4, and then is further turned by a wrench to press the side plate 4 down onto the rivets 11 until they protrude from the side plate 4 into the cut-outs 154 of the P bottom face 114. The pressing operation is then completed and the chain 1 is removed from the repair tool 100.

When the block 102 is turned sideways, as when used in riveting operations, the "R" marking 130 will be upright and located in the lower right hand corner as seen from the front of the labeled side 104. When the block 102 is in R orientation 136, the block 102 is seated in the lower jaw 156. The drive bolt 28 is not used in this operation, and is again backed out enough that the break pin is also withdrawn up into the body bolt 103. The block 102 is now aligned so that the R marking 130 is aligned with the Rivet marking 148, which serves as a reminder that the repair tool 100 is configured for Riveting operations.

An adapter 170 is fitted onto the body bolt 103, preferably by means of magnetic attachment, and a rivet tip 172, which is preferably a dual sided rivet tip 174, is also magnetically attached to the adapter 170. The dual sided rivet tip 174 is preferably reversible, so that if it turned in a first orientation, the rivet tip 172 is configured to engage hollow nose rivets, and is thus a hollow nose rivet tip 176, and if reversed, it is configured to engage quad stake rivets, and is thus a quad stake rivet tip 178. When not being used for riveting operations, the adapter 170 and dual sided rivet tip 174 attach to the end of the main handle 101 and thus do not require a special carrying case R top face 132 has hole 160 into which the end of the rivet 11 seats. R top face 132 also has side cut-outs 162 into which ends of neighboring rivets 11 can fit. R left sided face 138 also has location detents 164, which help maintain the block 102 in proper position.

When the vehicle chain repairing tool 100 is configured for riveting, the block 102 acts as an anvil upon which the master link 10 is seated. The side plate 4 has been previously pressed onto the rivets 11. The body bolt 103 is then tightened until the rivet tip 172 engages the head of the rivet 11, and then is further turned by a wrench to press the rivet tip 172 to spread the head of the rivet 11, and thus prevent its removal. A hollow nose rivet tip 176 has a dome-shaped tip, which engages the hollow cylinder of the hollow nose rivet, and forces the material to deform. A quad stake rivet tip 178 has a pyramidal cavity which engages the solid end of the quad stake rivet, and "swedges" the tip by deforming it into a four sided shape which also spreads the head of the rivet so it cannot be easily removed. The riveting operation is then completed and the chain 1 is removed from the vehicle chain repairing tool 100.

There are many advantages to the present vehicle chain repairing tool 100. The vehicle chain repairing tool 100 preferably includes a modified breaking pin 105 which includes a domed upper end 182, which more easily engages the lower end of the drive bolt 28 as it advances. This helps the breaking pin 105 stay aligned in the body bolt 103 while the drive bolt 28 is inserted. A common problem with many chain breakers is misalignment of the breaking pin. When the breaking pin is misaligned it can bind up in the body bolt and bend or break. The present invention prevents this type of damage.

The present body bolt 103 incorporates a tapered passage 107 which prevents the pin from getting get bound up on the internal lip of the body bolt and break the tool. This design makes the vehicle chain repairing tool 100 easier to use and reduces the chance of damage to the tool.

An additional advantage of the present invention is that it includes fewer parts by incorporated breaking, pressing and riveting operations into a single device by using the PBR block 102. This allows the user to quickly change from breaking the chain to pressing the new link on and then riveting, with fewer parts and less time spent swapping components. It also means less separate pieces that can get lost or that need to be stored. This all results in reduced manufacturing costs.

Another advantage is that the present invention is easier to use. With the PBR block 102, the user simply aligns the corresponding marks on the block 102 with the markings 142 on the body 22 and the alignment is done. Consequently, it is thought that the present invention needs little or no instructions, in comparison to the prior chain repair tool, which required several pages to explain its operation and re-configurations.

A further advantage is that the present invention has been designed to have no loose parts. The present vehicle chain repairing tool 100 includes a handle 101 that has the feature that its end acts as a storage place for the adaptor 170 and rivet tip 172 when not in use.

For the above, and other, reasons, it is expected that the vehicle chain repairing tool 100 of the present invention will have widespread industrial applicability. Therefore, it is expected that the commercial utility of the present invention will be extensive and long lasting.

What is claimed is:

1. A chain repairing tool, comprising:

a tool body:

a PBR block, which is configured for pressing side plates of chain links, for breaking chain links and for riveting chain links as said PBR block is variously oriented within said tool body of said chain repairing tool;

indicia on said PBR block which indicate whether said PBR block is presently oriented for pressing, for breaking or for riveting operations; and body indicia on said tool body which indicate whether said chain repairing tool is presently configured for pressing, for breaking or for riveting operations, wherein said indicia on said PBR block and said body indicia align to indicate for which operation the chain repairing tool is presently configured.

2. The chain repairing tool of claim 1, further comprising:

a body bolt which is threadably received by said tool body, and which has a lower end which is received by a cavity in the top face of said PBR block, when said PBR block is oriented for pressing operations.

3. The chain repairing tool of claim 2, wherein:

said tool body comprises a lower jaw having a groove for seating chain links; and the bottom face of said PBR block includes cut-outs for seating a chain link.

4. The chain repairing tool of claim 1, wherein:

said tool body comprises a lower jaw; and said chain repairing tool further comprises:

a body bolt which is threadably received by said tool body;

a drive bolt which is threadably engaged within said body bolt; and a breaking pin which is seated within said body bolt, and engaged with said drive bolt such that as said drive bolt is advanced within said body bolt, said breaking pin is advanced toward said lower jaw.

5. The chain repairing tool of claim 4, wherein:

the top face of said PBR block, when said PBR block is oriented for breaking operations, includes a through hole through which a chain pin or rivet is pushed when said chain is being broken.

6. The chain repairing tool of claim 4, wherein:

said breaking pin includes a domed head.

7. The chain repairing tool of claim 4, wherein:

said body bolt includes a tapered passage which guides said breaking pin.

8. The chain repairing tool of claim 1, further comprising:

the top face of said PBR block, when said PBR block is oriented for riveting operations, includes side cut-outs for seating chain links and a hole into which the end of a rivet seats.

9. The chain repairing tool of claim 8, further comprising:

a body bolt which is threadably received by said tool body;

an adaptor which attaches to the lower end of said body bolt, and which engages rivets for riveting operations.

10. The chain repairing tool of claim 9, wherein:

said adaptor is a dual sided rivet tip.

11. The chain repairing tool of claim 10, wherein:

said dual sided rivet tip includes a hollow nose rivet tip and a quad stake rivet tip.

12. The chain repairing tool of claim 9, wherein:

said chain repairing tool includes a main handle, and said adaptor is configured to attach to said main handle for storage when not in use.

13. A chain repairing tool, comprising:

a tool body:

a body bolt which is threadably received by said tool body;

a drive bolt which is threadably engaged within said body bolt, wherein said body bolt includes a tapered passage which guides said breaking pin; and a PBR block, which is configured for pressing side plates of chain links, for breaking chain links and for riveting chain links as said PBR block is variously oriented within said tool body of said chain repairing tool.

14. The chain repairing tool of claim 13, further comprising:

indicia on said PBR block which indicate whether said PBR block is presently oriented for pressing, for breaking or for riveting operations; and body indicia on said tool body which indicate whether said chair repairing tool is presently configured for pressing, for breaking or for riveting operations, wherein said indicia on said PBR block and said body indicia align to indicate for which operation the chain repairing tool is presently configured.

15. A chain repairing tool, comprising:

a tool body:

a body bolt which is threadably engaged by said tool body;

a drive bolt which is threadably engaged within said body bolt; and a breaking pin which is seated within said body bolt, and engaged with said drive bolt such that as said drive bolt is advanced within said body bolt, said breaking pin is advanced, and where said breaking pin includes a domed head.

16. The chain repairing tool of claim 15, further comprising:

a PBR block, which includes indicia on said PBR block which indicate whether said PBR block is presently oriented for pressing, for breaking or for riveting operations and which is configured for pressing side plates of chain links, for breaking chain links and for riveting chain links as said PBR block is variously oriented within said tool body of said chain repairing tool.

17. The chain repairing tool of claim 16, further comprising:

body indicia on said tool body which indicate whether said chair repairing tool is presently configured for pressing, for breaking or for riveting operations, wherein said indicia on said PBR block and said body indicia align to indicate for which operation the chain repairing tool is presently configured.

18. A PBR block, which is configured for pressing operations on side plates of chain links, for breaking operations on chain links, and for riveting operations on chain links, as said PBR block is variously oriented, in conjunction with a chain repairing tool having a body bolt, said PBR block comprising:

indicia on said PBR block which indicate whether said PBR block is presently oriented for pressing, for breaking, or for riveting operations;

the top face of said PBR block, when said PBR block is oriented for pressing operations, includes a cavity for insertion of an end of said body bolt of said chain repairing tool, and the bottom face of said PBR body includes cut-outs for seating a chain link;

the top face of said PBR block, when said PBR block is oriented for breaking operations, includes a through hole through which a chain pin or rivet is pushed when said chain is being broken; and the top face of said PBR block, when said PBR block is oriented for riveting operations, includes side cut-outs for seating chain links and a hole into which the end of a rivet seats.

* * * * *